US006325112B1

(12) United States Patent
Nanaji

(10) Patent No.: US 6,325,112 B1
(45) Date of Patent: Dec. 4, 2001

(54) VAPOR RECOVERY DIAGNOSTIC SYSTEM

(75) Inventor: Seifollah S. Nanaji, Greensboro, NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

(21) Appl. No.: 09/502,588

(22) Filed: Feb. 11, 2000

(51) Int. Cl.[7] ..... B65B 31/00; B67C 3/00

(52) U.S. Cl. ..... 141/4; 141/2; 141/44; 141/59; 141/83; 141/94; 141/285; 141/302

(58) Field of Search ..... 141/2, 4–8, 44, 141/45, 83, 59, 94, 285, 290, 302, 392

(56) References Cited

U.S. PATENT DOCUMENTS

| | | | |
|---|---|---|---|
| 5,429,159 | 7/1995 | Tees et al. | 141/59 |
| 5,450,883 | 9/1995 | Payne et al. | 141/59 |
| 5,671,785 | 9/1997 | Andersson | 141/59 |
| 5,715,875 | 2/1998 | Clary et al. | 141/59 |
| 5,779,097 | 7/1998 | Olson et al. | 222/39 |
| 5,857,500 | 1/1999 | Payne et al. | 141/59 |
| 5,860,457 | 1/1999 | Andersson | 141/59 |
| 5,913,343 | 6/1999 | Andersson | 141/59 |
| 5,944,067 | 8/1999 | Andersson | 141/59 |
| 5,988,232 * | 11/1999 | Kock et al. | 141/59 |
| 5,992,395 * | 11/1999 | Hartsell, Jr. et al. | 123/516 |
| 6,082,415 * | 7/2000 | Rowland et al. | 141/59 |

FOREIGN PATENT DOCUMENTS

WO 00/55047 9/2000 (WO) .

* cited by examiner

*Primary Examiner*—Timothy L. Maust
(74) *Attorney, Agent, or Firm*—Withrow & Terranova PLLC

(57) ABSTRACT

A vapor system for a fuel dispenser having at least one vapor sensor placed along a vapor recovery line for determining the amount of captured vapor. The vapor amounts are determined by the sensor at a number of times during the fueling process. These are sent to a control system which compares the amounts and determines whether they are within a predetermined range. Consistent readings indicate that the vapor recovery system is operating correctly. Inconsistent results indicate either a leak within the vapor recovery line, or fuel is being drawn into the vapor recovery line. These problems within the vapor recovery system can be diagnosed and the necessary corrective steps may be implemented.

22 Claims, 3 Drawing Sheets

VAPOR RECOVERY DIAGNOSTIC SYSTEM

FIELD OF THE INVENTION

The present invention is directed to a system for monitoring a vapor recovery system and, more particularly, to a system that determines a vapor level in a vapor recovery line at a plurality of time periods and compares the results to determine whether the vapor recovery system is adequately operating.

BACKGROUND OF THE INVENTION

Vapor recovery equipped fuel dispensers, particularly gasoline dispensers, have been known for quite some time, and have been mandatory in areas that are required to do so by the Clean Air Act Amendments passed by the United States Congress. The primary purpose of a vapor recovery system is to recover vapors displaced from a vehicle's fuel tank during a fueling process that would otherwise be emitted to the atmosphere. As liquid gasoline is pumped into the tank, the vapor is displaced and forced out through the vehicle filler pipe. Other volatile hydrocarbon liquids raise similar issues. In addition to the need to recover vapors, some states, and California in particular, are requiring extensive reports about the efficiency with which vapor is recovered.

A traditional vapor recovery system is known as the "balance" system, in which a sheath or boot encircles the liquid fueling spout and connects by tubing back to the fuel reservoir. As the liquid enters the tank, the vapor is forced into the sheath and back toward the fuel reservoir or underground storage tank (UST) where the vapors can be stored or recondensed. Balance systems have numerous drawbacks, including cumbersomeness, difficulty of use, ineffectiveness when seals are poorly made, and slow fueling rates.

As a dramatic step to improve on the balance systems, Gilbarco, Inc., assignee of the present invention, patented an improved vapor recovery system for fuel dispensers, as seen in U.S. Pat. No. 5,040,577, now Reissue Pat. No. 35,238 to Pope, which is herein incorporated by reference in its entirety. The Pope patent discloses a vapor recovery apparatus in which a vapor pump is introduced in the vapor return line and is driven by a variable speed motor. The liquid flow line includes a pulser, conventionally used for generating pulses indicative of the liquid fuel being pumped. This permits computation of the total sale and the display of the volume of liquid dispensed and the cost in a conventional display, such as shown in U.S. Pat. No. 4,122,524 to McCrory et al. A microprocessor translates the pulses indicative of the liquid flow rate into a desired vapor pump operating rate. The effect is to permit the vapor to be pumped at a rate correlated with the liquid flow rate so that, as liquid is pumped faster, vapor is also pumped faster.

There are three basic embodiments used to control vapor flow during fueling operations. A first embodiment is the use of a constant speed vapor pump during fueling without any sort of control mechanism. A second is the use of a pump driven by a constant speed motor coupled with a controllable valve to extract the desired amount of vapor from the vehicle gas tank. While the speed of the pump is constant, the valve may be adjusted to increase or decrease the flow of vapor. A third is the use of a variable speed motor and pump as described in the Pope patent, which is used without a controllable valve assembly. All of these techniques have advantages either in terms of cost or effectiveness. Depending on the reasons driving the installation, any of the three may be appropriate, however none of the three systems, or the balance system as currently implemented by the dispenser manufacturers, are able to provide all the diagnostic information that may be required in the future. The present state of the art is well shown in commonly owned U.S. Pat. No. 5,345,979, which is herein incorporated by reference in its entirety.

The amount of vapor produced during the fueling process is a function of the fuel rate. By way of example, a dispensing rate of two gallons of fuel per minute should emit more vapor than a dispensing rate of one gallon of fuel per minute. Because the fuel rate is known, the expected amount of vapor recovery may also be determined. Present systems place a sensor within the vapor recovery line for determining the amount of vapor within the vapor recovery line. However, these sensors are often used to determine whether the vehicle receiving fuel has an on-board vapor recovery system (ORVR). Another current use is for adjusting the speed of the vapor pump. If the amount of vapor determined by the sensor is not equal to the expected vapor for the amount of fuel being dispensed, the system will alter the speed of the vapor pump, or adjust the valve within the recovery line to obtain the expected results.

A drawback of these existing systems is there is no means for determining whether the vapor recovery system is effectively operating. One problem occurs if there is a leak in the vapor recovery system. Outside air is captured through the leak and drawn into the UST, instead of the vapors emanating from the fuel tank during the fueling process. Leaks in the vapor recovery system are especially problematic in the hanging hardware along the nozzle, hose, and swivel connections. Presently existing systems recognize that not enough vapor is being recovered, and increase the speed of the vapor pump. However, this results in more outside air being pulled into the UST, and does not have any effect on fixing or even indicating that there is a leak.

Another problem occurs when the vapor recovery system draws fuel during the fueling event into the UST. This may occur when the vapor recovery system draws fuel from the user's tank either during or after it has been dispensed. Another situation occurs if there is a leak within the fuel delivery line within the hanging hardware as the fuel leaks from the delivery line directly into the vapor recovery line which is in close proximity. In either of these situations, the fuel has passed through the pulser, the dispenser indicates the fuel has been delivered, and the user is paying for the fuel. Additionally, the vapors emanating during the fueling event are not being captured as the capacity of the recovery line is taken by the leaking fuel.

It is important that the problem of air leaking into the vapor recovery system, or fuel being pulled through the system is recognized. Thus, there remains a need for the sensors placed within the vapor recovery line to be used for diagnostic purposes for determining whether the vapor recovery system is operating effectively.

SUMMARY OF THE INVENTION

The present invention provides for testing the amount of vapor captured by the vapor recovery system at periodic time intervals during the fueling event. If the amounts captured are not stable, it is assumed there is either a leak in the vapor recovery system or fuel is being drawn into the vapor recovery system. In either event, preventive measures may be implemented at the time of the fueling event to correct these problems.

In a first embodiment, a vapor level sensor is placed within the vapor recovery line for detecting the amount of vapor being captured during the fueling event. Preferably, a number of vapor level readings are taken at the beginning of the fueling event and a base vapor level is obtained by using a number of statistical methods. Additional vapor readings are taken at periodic time intervals during the fueling event and compared to the base vapor level. When the two readings are within a predetermined range, it is assumed that the vapor recovery system is operating correctly. However, if the two readings are not within the predetermined or a statistically determined range, there is a problem with the vapor recovery system and preventive measures are taken including logging the readings in a log book, notifying a site controller, notifying a central controller, or notifying the user. Preferably, a control system within the fuel dispenser monitors the vapor readings, performs the comparisons, and notifies the respective persons in the event of a problem.

In determining the base vapor level, the control system preferably receives a number of vapor level readings obtained during the initial fueling event. The control system may determine whether these readings are stable and within a given range. If the readings are within the range, the control system assumes there is no initial problem with the vapor recovery system. However, either a leak in the system or pulling fuel into the system may result in the readings being unstable and fluctuating erratically resulting in the control system taking preventive measures and no base vapor level being calculated. In a second embodiment, more than one vapor sensor is placed within the vapor recovery line. A first, upstream sensor obtains the vapor amount within the vapor recovery line. After a predetermined period of time based on the vapor flow rate and distance between the first and a second sensor, a vapor amount is obtained at the second, downstream sensor. Again, these amounts are compared directly or statistically. If they are not within a given range, a leak or other problem is occurring within the system.

DETAILED DESCRIPTION OF THE INVENTION

Figure 1:
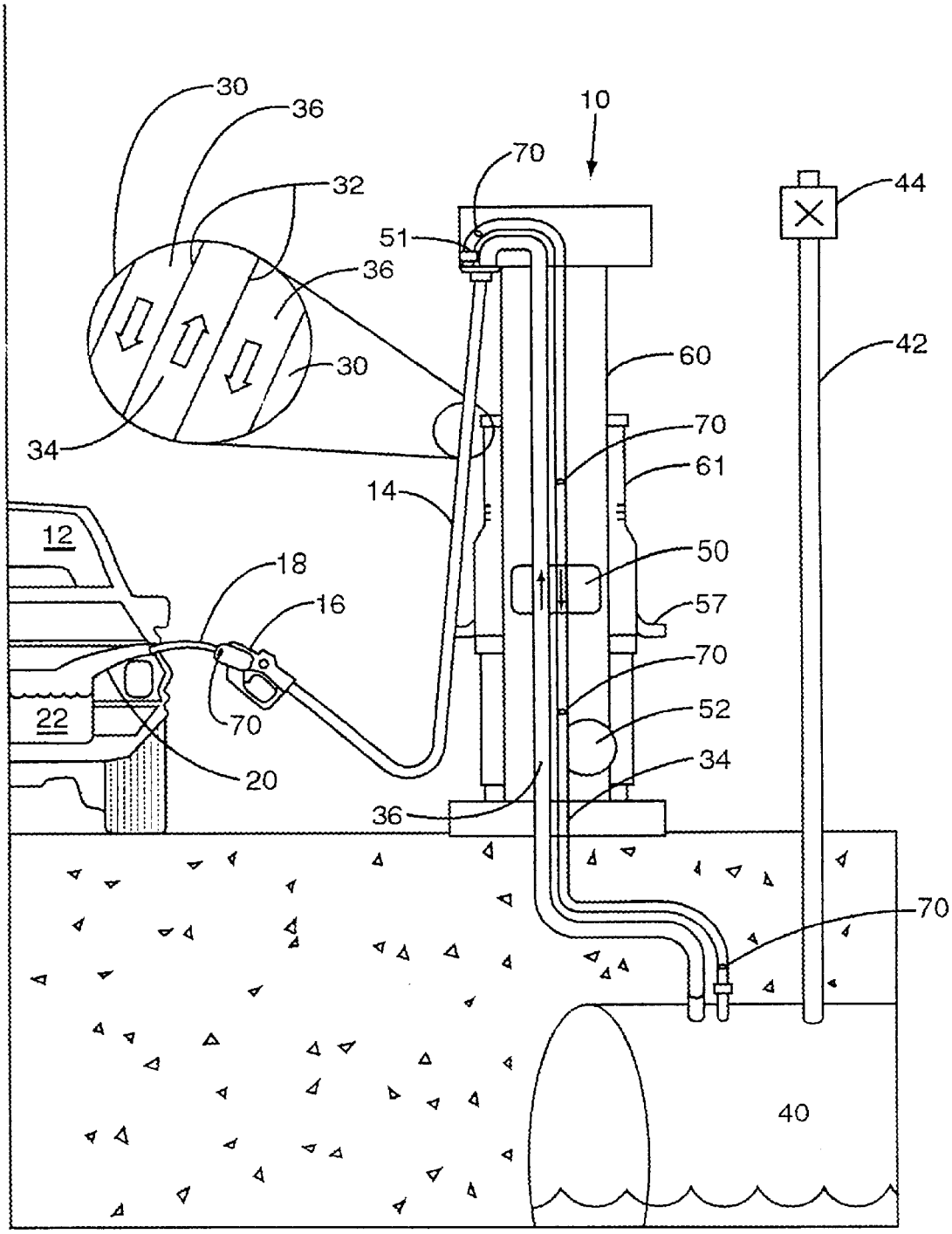
FIG. 1 is a schematic diagram illustrating the elements of a fuel dispenser and vapor recovery system constructed in accordance with the present invention.

In the following description, like reference characters designate like or corresponding parts throughout the Figures. Also, terms such as "forward", "backward", "left", "right", "upwardly", "downwardly", and the like are words of convenience and are not to be construed as limiting terms. Certain modifications and improvements will occur to those skilled in the art upon a reading of the following description. It should be understood that all such modifications and improvements have been deleted herein for the sake of conciseness and readability but are properly within the scope of the claims.

The present invention is directed to a vapor recovery system for a fuel dispenser. At least one sensor 70 is placed along the vapor recovery line 34 for determining the amount of captured vapor. The amounts determined by the sensors 70 at a number of times during the fueling process are compared to determine whether the vapor recovery system is properly operating. The results of the comparisons can determine whether there is a leak within the vapor recovery line 34, or fuel is being drawn into the vapor recovery line. These problems within the vapor recovery system can be diagnosed and the necessary corrective steps may be implemented.

Turning now to FIG. 1, a fuel dispenser 10 is adapted to deliver fuel, such as gasoline or diesel fuel, to a vehicle 12. The fuel is stored in an underground storage tank (UST) 40 and is pumped by a fuel pump (not illustrated) through a fuel delivery line 36 to the nozzle 16 during a fueling event. Preferably, the vehicle 12 includes a fill neck 20 and a tank 22, which accepts the fuel and provides it through appropriate fluid connections to the engine (not illustrated) of the vehicle 12.

The nozzle 16 and delivery hose 14 include both the product delivery line 36 and a vapor return line 34 as illustrated in FIG. 1. The product delivery line 36 and vapor recovery line 34 are further aligned within the delivery hose 14 preferably with the product line extending along an annular outer portion and the vapor line within an interior portion. The vapor recovery line 34 extends through the dispenser 10 and terminates in the UST 40. The UST 40 may also be equipped with a vent shaft 42 and a vent valve 44. During delivery of fuel into the vehicle tank 22, and returning fuel vapor into the UST 40, air may be vented through the vent shaft 42 and valve 44 to equalize the pressure within the tank.

A housing 60 extends around the portion of the fuel dispenser. The housing 60 includes boots 57 for placing the nozzle 16 when not in use. Display screens 61 may be positioned on the housing 60 for informing the consumer of their purchase. The display screens 61 may include information regarding the fueling process including the type of fuel, cost, and gallons dispensed, as well as various other products or services offered.

A hanging hardware section of the fuel and vapor recovery system is positioned exterior to the housing 60. This includes the nozzle 16, and hose 14 which are susceptible to having leaks, mainly because of the repetitive handling during numerous fueling events, and also being exposed to the elements. Also as illustrated in the enlarged portion of FIG. 1, the vapor recovery line 34 and delivery line 36 are positioned side-by-side. A leak within the delivery line 36 may result in fuel entering directly into the vapor recovery line 34

A vapor pump 52 provides a vacuum for pulling vapor at the spout 18 into the vapor recovery line 34 and propelling the vapor into the underground storage tank 40. Vapor valves 51 may be positioned at various points in the vapor recovery line 34 for controlling the amount of vapor flow. The vapor pump 52 and vapor valve 51 allows for three basic embodiments to control vapor flow during fueling operations. The first embodiment is a constant speed vapor pump with the vapor valve 51 being selectively positionable in either an open or closed position. The second embodiment is a vapor pump driven by a constant speed motor with vapor valve 51 selectively positionable at a variety of positions and adjusted to increase or decrease the flow of vapor. The third embodiment is a variable speed motor and pump in combination with valve 51 adjustable between either an open or closed alignment. One type of variable of speed motor and pump is that described in U.S. Pat. No. 5,040,577, now reissue Pat. No. 35,238, herein incorporated by reference in its entirety.

Vapor level sensors 70 are positioned along the vapor recovery line 34 for determining the amount of vapor levels recovered during the fueling process. As illustrated in FIG. 1, vapor level sensors 70 may be positioned at a variety of positions along the vapor recovery path including within the nozzle 16, inside the housing 60, or adjacent to the UST 40. Additionally, more than one vapor level sensor 70 may be positioned along the vapor recovery line 34. The vapor level sensors 70 may operate directly by determining the amount of vapor level being recovered, or indirectly by determining the amount of air being recovered and calculating a resultant vapor amount. The vapor level sensors 70 may determine the concentration of the vapor, the flow rate of the vapor within the vapor recovery line, pressure changes within the vapor recovery line, or a combination of these to determine the volume of the vapor. Addtionally, the sensors 70 may detect the presence of various types of vapors including hydrocarbons, oxygen, nitrogen, etc. Any number of different sensor types may be positioned along the vapor recovery line 34. By way of example, both a hydrocarbon sensor and nitrogen sensor may be positioned at different points along the same line. Different types of vapor level sensors 70 used in the present application are described in U.S. Pat. Nos. 5,913,343, 5,944,067, 5,860,457, and 5,671,785 herein incorporated by reference in their entirety.

A control system 50 monitors the overall working of the fueling and vapor recovery. The control system 50 receives signals from the vapor level sensors 70, vapor pump 52, fuel pump, and vapor valves 51 to determine the amount of fuel being dispensed, and the amount of vapor being returned to the UST 40 through the vapor recovery line 34. Data may be stored within the control system 50 in a conventional memory unit such as a read only memory (ROM), programmable read only memory (PROM), random access memory (RAM), or flash memory accessible by the control system 50. A clock may also be accessible by the control system 50 for determining the time periods between vapor readings, and the time period for the vapor to pass along the vapor recovery line.

Figure 2:
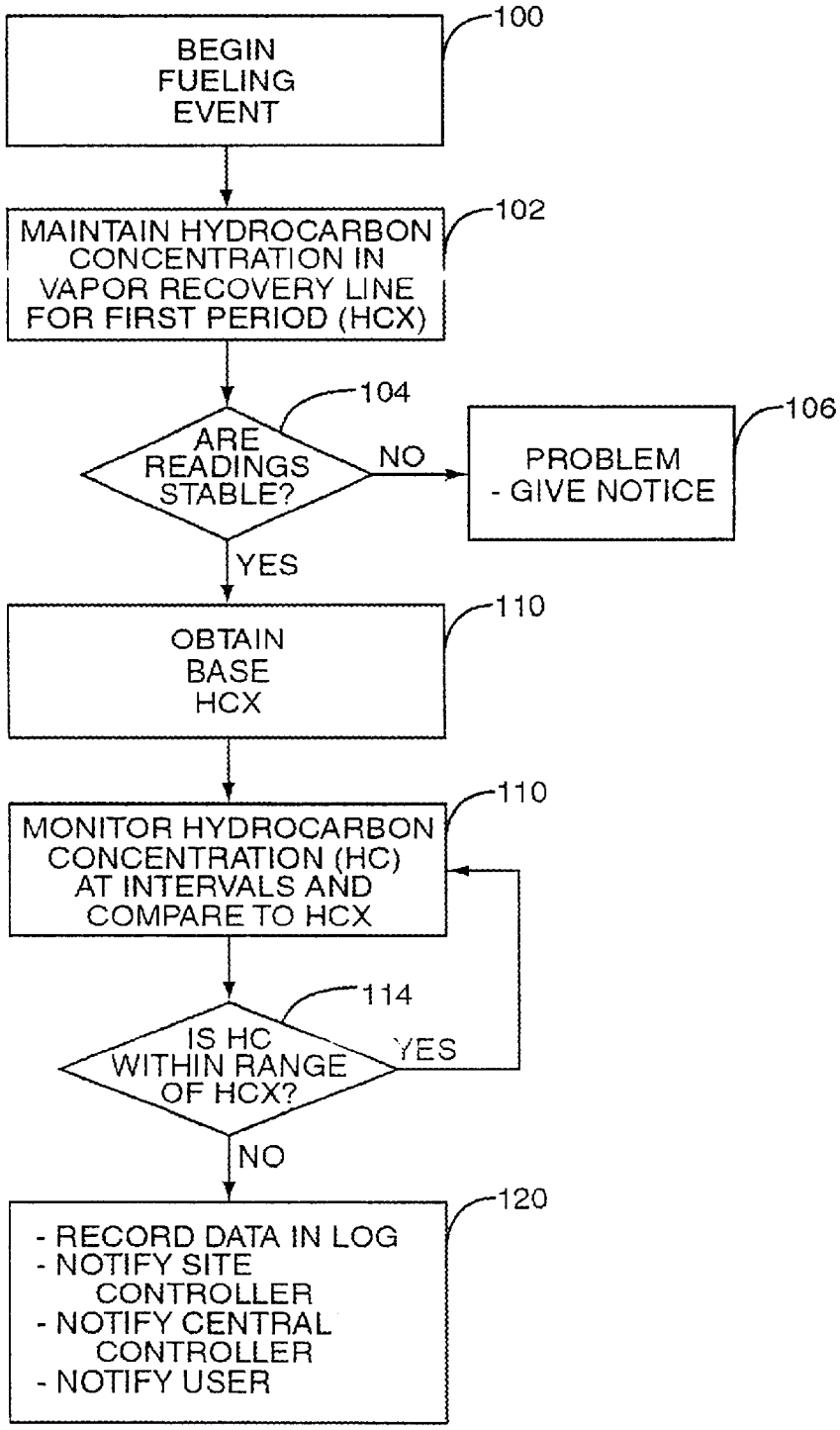
FIG. 2 is a flowchart diagram illustrating the steps for testing vapor within the vapor recovery line with one sensor.

FIG. 2 illustrates the steps performed by the system having a single vapor sensor 70 positioned within the vapor recovery line 34. The fueling event is commenced (block 100) usually by the user selecting the type of fuel desired and payment method, and then removing the nozzle 16 from the dispenser housing 60 and placing it within the fill neck 20 and tank 22. Once the fuel pump is powered, the vapor recovery pump 52 is also powered to draw the vapor into the vapor recovery line 34 and the vapor levels are monitored for an initial period (block 102). In one embodiment, the control system 50 begins receiving vapor levels from the sensor 70 at the start of fuel flow. Alternatively, the control system 50 may allow for a brief initialization period during which the fuel is first dispensed prior to taking vapor levels. When fuel is first delivered to into the tank 22, an increased amount of vapor is produced. This brief initialization period allows for this increased vapor period to occur prior to recording the levels so as not to provide inconsistent vapor readings.

The control system 50 receives the vapor levels obtained by the sensor 70 during the initial period of time and determines whether they are stable (block 104). Within the present invention, the term "stable" means the readings fall within a predetermined range and there are numerous statistical methods used for making this determination. In one method, the control system 50 records each of the vapor levels obtained during the initial time period and obtains an average. The system 50 then determines whether any of the individual readings fall outside of a predefined range from the average. By way of example, if one of the readings was twenty percent higher than the average, the control system 50 would indicate a problem. Likewise, two or more readings outside of the predefined range may indicate a problem with the vapor recovery system. When there are no leaks within the system, and no fuel is being pulled into the vapor recovery line 34, the vapor levels taken over the period of time should fall within the predefined range.

Another method of determining whether the vapor levels are stable includes taking the highest and lowest vapor levels determined during the initial time period. If these values are outside of a predefined range, then the control system 50 indicates a problem.

The period of time over which the readings are taken to obtain the base level may vary from a single reading in which no calculations are required to determine stability, to an extended time period. Additionally, the number of readings within the time period may also vary depending upon the system.

If the readings are not stable, the control system 50 will recognize this as a problem with the vapor recovery system (block 106). Corrective measures include recording the readings within a log book in the memory at the control system 50, sending a message to a site controller, sending a message to a central controller, or possibly sending a message to the unit display 61 notifying the user of the problem and stopping the fueling event. If the vapor levels are stable and within the expected range, a base vapor level, referenced as HCX, will be determined (block 110).

During the fueling event, the vapor sensors 70 monitor the level of vapors within the vapor recovery line 34. At periodic intervals, the control system 50 receives the vapor level, referenced as HC (block 112). Preferably, HC is the vapor level within the vapor recovery line 34 at an instant in time. Alternatively, HC may again be an average of the vapor level within the line 34 over a period of time. The control system 50 compares HCX with HC to determine if there is any difference between the readings (block 114). If there is no difference in the readings, the control system 50 assumes there is no problem with the vapor recovery system and will continue to take periodic vapor level readings and compare them to HCX.

Variations in levels between HCX and HC may be common and not indicative of a problem with the system. Variations may be ignored by the control system 50, or may be recorded in the log book for later evaluation. By way of example, a variation of five percent between HCX and HC may not indicate a leak, but will be recorded in the log book. Upon recording a predetermined number of minor variations, the control system 50 may be programmed to contact a site controller or central controller, or take other necessary preventive steps.

When the vapor levels are different and outside of an acceptable range, the control system 50 recognizes a problem with the vapor recovery. When the initial HCX is greater than the later recorded HC, this is indicative that air is leaking into the vapor line 34 from a leak and/or damage to the hanging hardware or piping forming the vapor recovery line. When HCX is less then the HC, liquid is entering the vapor line 34 either from the user topping off the tank 22, or a leak in the fuel delivery line 36. In these situations, the control system 50 may record the data within the log book, and/or notify the site controller, and/or notify the central controller. The user may be notified of the problem by a message displayed on the display unit 61, and the fueling event may be terminated. These preventive steps may be taken in order of severity. By way of example: a five percent different between HC and HCX may result in the control system 50 recording the discrepancy in the log book, and not performing any further preventive steps until a predetermined number of discrepancies have been recorded. A seven percent difference may cause the site controller to be notified. A ten percent difference may result in the user and central controller being notified. A fifteen percent difference may result in the fueling event being terminated.

Another cause of the discrepancy in values may be the temperature difference between the vehicle 12 and the UST 40. Warmer fuel contacting a cooler tank 22, and cooler fuel contacting a warmer tank 22 may result in fluctuations in the amount of vapor. Temperature sensors may be positioned in the UST 40, on the nozzle 16, or in the vapor return line 34 to indicate temperature discrepancies that result in varying amounts of recovered vapor.

The present invention may also use expected amounts of generated vapor. These amounts may be determined from historical testing of previous vapor recovery systems, laboratory testing, or other like manner. These expected amounts of vapor are used instead of obtaining a base vapor level. A table of reference with vapor amounts corresponding to various pump speeds and fuel types is stored in the control unit 50. During the fueling event, the sensor 70 obtains vapor levels from the vapor recovery line that are compared to the stored value and discrepancies are not or otherwise handled. The drawback of this embodiment, however, is it does not account for a problem within the vapor recovery system at the start of the fueling event.

Figure 3:
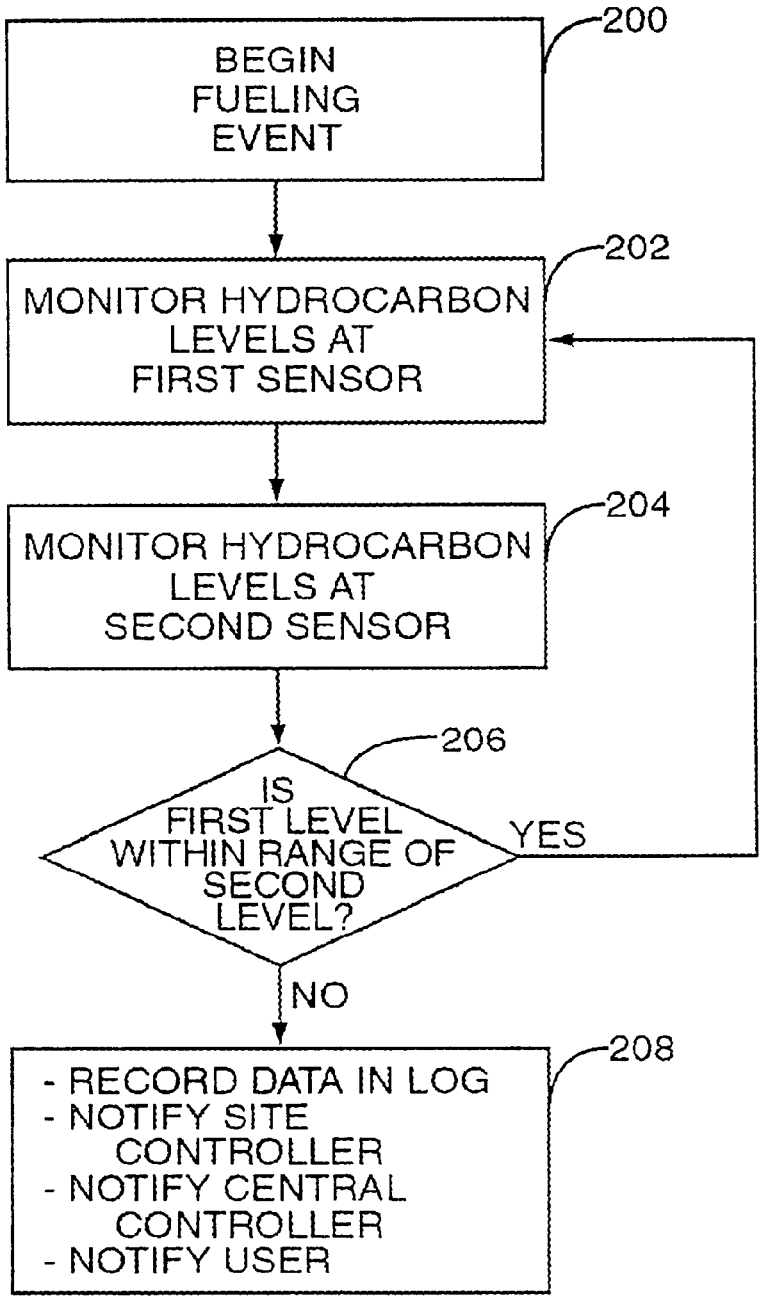
FIG. 3 is a flowchart diagram illustrating the steps for testing vapor within the vapor recovery line with more than one sensor.

FIG. 3 illustrates another embodiment featuring more than one sensor 70 positioned along the vapor recovery line 34. In this embodiment, there are two separate vapor level sensors, a downstream and an upstream sensor, although it is understood that there may be more than two positioned along the line 34. The process is initiated by the beginning of the fueling event as fuel is delivered to the user (block 200). A first, upstream vapor sensor obtains a first vapor level that is then sent to the control system 50 (block 202). The control system then determines the amount of time necessary for the vapor to travel to the second vapor sensor that is positioned a distance downstream. This time period between the first and second readings is determined by programming the distance between the sensors and the rate of vapor flow through the vapor recovery line 34. The control system 50 obtains a vapor level from the second, downstream sensor at the time when the vapor that is tested by the first sensor passes the second sensor (block 204). The control system 50 compares the two levels (block 206). If they are the same, or within an acceptable range, the control system 50 determines the system is working properly. If there is a discrepancy, the system has a variety of corrective measures including registering the information in the log book, notifying the site controller, notifying the central controller, and notifying the user (block 208). As with the previous system, these corrective actions may be determined based upon the amount of discrepancy between the readings, or the number of recorded discrepancies.

Various changes may be made to the system described and still be considered within the scope of the invention. It is noted that the vapor sensors 70 may also be used to detect reverse flow of vapor from the UST 40 to the atmosphere through the vapor recovery line 34. Additionally, when using the various testing procedures, the minimum and maximum sensor output should be the same within a certain tolerance limit. When the outputs are different from each other, the sensor 70 and/or other components of the vapor recovery system should be checked for damage.

What is claimed is:

1. A method of monitoring a vapor recovery system for a fuel dispenser during a fueling event comprising the steps of:

obtaining a first vapor level within a vapor recovery line of a vapor recovery system;

comparing the first vapor level to each of a plurality of second vapor levels obtained during the fueling event; and determining if there is a malfunction in said vapor recovery system based upon the comparison between the first and second vapor levels.

2. The method of claim 1, further including taking one or more preventive steps when the malfunction is determined.

3. The method of claim 2, wherein the one or more preventive steps is selected from the group consisting of recording the discrepancy within a control system, notifying a site controller, and notifying a central controller.

4. The method of claim 1, wherein the first and second vapor levels are obtained from a single vapor level sensor positioned within the vapor recovery line.

5. The method of claim 4, wherein the first vapor level is calculated from a plurality of vapor levels obtained from the vapor level sensor over a predetermined period of time.

6. The method of claim 5, wherein the predetermined period of time is at the beginning of the fueling event.

7. The method of claim 5, wherein the first vapor level is an average of the plurality of vapor levels obtained over the predetermined period of time.

8. The method of claim 5, wherein the plurality of vapor levels are compared statistically compared to determine if they are within a predetermined range.

9. The method of claim 1, wherein the first vapor level is a historic amount.

10. The method of claim 9, wherein the historic amount is stored in a control system.

11. The method of claim 1, wherein each of the second vapor levels are obtained at periodic time intervals.

12. A method of testing a vapor recovery system within a fuel dispenser comprising the steps of:

obtaining a first vapor amount from a first vapor level sensor positioned along a vapor recovery line;

waiting a predetermined time period and then obtaining a second vapor amount from a second vapor level sensor positioned along the vapor recovery line downstream of the first vapor level sensor; and comparing whether the vapor amounts obtained from the first and second vapor level sensors are within a predetermined range.

13. The method of claim 12, further including taking preventive steps when the vapor amounts obtained from the first and second vapor level sensors are outside of the predetermined range.

14. The method of claim 12, further including placing at least one additional vapor level sensor along the vapor recovery line for obtaining additional vapor amounts.

15. The method of claim 12, further including periodically comparing additional vapor amounts from the first and second vapor sensors obtained during a fueling event.

16. A system for monitoring vapor amounts in a fuel dispenser comprising:

a vapor recovery line;

a vapor pump for drawing vapor along said vapor recovery line;

a vapor level sensor positioned within said vapor recovery line; and a control system operatively communicating with said vapor pump and said vapor level sensor, said control system receiving a plurality of vapor amounts obtained from said at least one vapor sensor and statistically comparing said amounts to determine whether they are within a predetermined range.

17. The system of claim 16, wherein said control system includes a log book for recording said vapor amounts.

18. The system of claim 16, further including a historic vapor amount stored within said control system for comparing with said vapor levels obtained from said vapor level sensor.

19. A system of monitoring a vapor recovery system in a fuel dispenser during a fueling event comprising:

a vapor recovery line;

a vapor pump for pulling vapors along said vapor recovery line;

a first vapor level sensor positioned along said vapor recovery line;

a second vapor level sensor positioned along said vapor recovery line downstream of said first vapor level sensor; and a control system operatively connected to and receiving vapor amounts from said first and second vapor level sensors and determining whether said amounts are within a predetermined range.

20. The system of claim 19, further including a clock within said control system for determining the time period for the vapor to move along said vapor recovery line between said first and second vapor level sensors.

21. The system of claim 19, further including taking one or more preventive steps when the amounts are outside of said predetermined range.

22. The system of claim 21, wherein the one or more preventive steps are selected from the group consisting of recording the discrepancy with said control system, notifying a site controller, and notifying a central controller.

* * * * *